US009546504B2

(12) United States Patent
Overgaard

(10) Patent No.: US 9,546,504 B2
(45) Date of Patent: Jan. 17, 2017

(54) MOTORISED DOOR LOCK ACTUATOR

(71) Applicant: POLY-CARE ApS, Harlev J (DK)

(72) Inventor: Henning Overgaard, Harlev J (DK)

(73) Assignee: POLY-CARE ApS, Harlev J (DK)

( * ) Notice: Subject to any disclaimer, the term of this patent is extended or adjusted under 35 U.S.C. 154(b) by 239 days.

(21) Appl. No.: 14/508,042

(22) Filed: Oct. 7, 2014

(65) Prior Publication Data

US 2015/0096341 A1 Apr. 9, 2015

(30) Foreign Application Priority Data

Oct. 7, 2013 (DK) ..... 2013 70555

(51) Int. Cl.

*E05B 63/00* (2006.01)
*E05B 47/02* (2006.01)
*E05B 47/00* (2006.01)

(52) U.S. Cl.

CPC ..... *E05B 63/0056* (2013.01); *E05B 47/02* (2013.01); *E05B 2047/002* (2013.01); *E05B 2047/0058* (2013.01); *E05B 2047/0091* (2013.01); *E05B 2047/0094* (2013.01); *Y10T 70/7136* (2015.04)

(58) Field of Classification Search

CPC ..... E05B 81/25; E05B 47/0012; E05B 81/06; E05B 81/16; E05B 2047/0017; E05B 85/02; E05B 2047/002; E05B 2017/043; E05B 2047/0021; E05B 2047/0024; E05B 2047/0054; E05B 81/64; E05B 81/66; E05B 81/34; E05B 81/48; E05B 2047/0091; E05B 2047/0094; E05B 47/02; E05B 81/08; E05B 81/38; E05B 63/0056; Y10T 70/7102; Y10T 70/7136

USPC ..... 70/277, 278.3, 278.7, 256, 381

See application file for complete search history.

(56) References Cited

U.S. PATENT DOCUMENTS

| | | | | |
|---|---|---|---|---|
| 4,901,545 A | | 2/1990 | Bacon et al. | |
| 5,609,051 A | * | 3/1997 | Donaldson | E05B 47/0673 340/5.54 |
| 5,712,626 A | * | 1/1998 | Andreou | E05B 47/0012 340/5.22 |
| 6,076,383 A | * | 6/2000 | Clark | G07C 9/00698 192/48.3 |
| 6,116,066 A | * | 9/2000 | Gartner | E05B 41/00 292/348 |

(Continued)

FOREIGN PATENT DOCUMENTS

| | | |
|---|---|---|
| DK | 201000185 U3 | 1/2012 |
| WO | 2005024160 A1 | 3/2005 |
| WO | 2012177609 A1 | 12/2012 |

OTHER PUBLICATIONS www.August.com; "Welcome to August Smart Lock".

*Primary Examiner* — Suzanne Barrett

(74) *Attorney, Agent, or Firm* — James Creighton Wray; Meera P. Narasimhan

(57) ABSTRACT

Actuation system for a door lock, where the door lock comprises a lock bolt driven by rotation of a lock pin that is functionally connected to the lock bolt. The actuation system comprises a cylindrical handle (5) with an outer diameter of between 6 and 9 cm. The system comprises a first pin receiver (8*a*) centred on the cylinder axis and a second pin receiver (8*b*) provided off centred between the cylinder axis and the cylindrical handle in order to be flexible with respect to post-mounting the actuating system on doors with already existing lock.

15 Claims, 5 Drawing Sheets

(56) References Cited

U.S. PATENT DOCUMENTS 6,216,502 B1 * 4/2001 Cannella ..... E05B 47/0012 292/142
6,264,256 B1 * 7/2001 Hankel ..... E05B 47/0615 292/336.3
7,389,661 B2 * 6/2008 Viviano ..... E05B 55/005 70/190
7,963,134 B2 * 6/2011 Rafferty ..... E05B 13/00 192/69.8
8,272,240 B1 * 9/2012 Schilens ..... E05B 1/0092 292/336.3
8,490,443 B2 * 7/2013 Gokcebay ..... G07C 9/00666 70/214
8,742,889 B2 * 6/2014 Kaczmarz ..... G06Q 10/087 235/382
2002/0056300 A1 * 5/2002 Pierre ..... E05B 47/0688 70/303 A
2004/0245785 A1 * 12/2004 Chen ..... E05B 47/0012 292/144
2006/0101878 A1 * 5/2006 Dickhans ..... E05B 47/0012 70/279.1
2007/0257773 A1 * 11/2007 Hill ..... E05B 17/2088 340/5.73
2008/0072637 A1 * 3/2008 Padilla ..... E05B 9/086 70/371
2009/0173120 A1 * 7/2009 Lin ..... E05B 17/0058 70/279.1
2010/0011822 A1 1/2010 Imedio Ocana
2010/0064744 A1 * 3/2010 Miller ..... E05B 9/00 70/280
2010/0257906 A1 * 10/2010 Sorensen ..... E05B 47/068 70/91
2011/0265527 A1 * 11/2011 Saari ..... E05B 47/0011 70/91
2011/0291428 A1 * 12/2011 Milton-Benoit .... E05B 47/0692 292/228
2013/0192318 A1 * 8/2013 Yanar ..... E05B 47/0012 70/279.1
2014/0109633 A1 * 4/2014 Romero ..... E05B 47/0684 70/133
2015/0096341 A1 * 4/2015 Overgaard ..... E05B 47/02 70/283.1
2016/0145900 A1 * 5/2016 Kaiser ..... E05B 47/0611 70/283.1

* cited by examiner

MOTORISED DOOR LOCK ACTUATOR

FIELD OF THE INVENTION

The present invention relates to a motorised lock for a door, for example apartment door. Especially, it relates to a post-mount actuation system for a door lock.

BACKGROUND OF THE INVENTION

In order to facilitate the operation of door locks, electrical motors are provided for post-mount on existing locks in doors. Retrofit motors for electrical actuation of a door lock are disclosed in US patent application No. 2010 0011822 and U.S. Pat. No. 4,901,545 as well as International patent application WO2012 177609, where a bezel is used for manually opening the lock but which also has a number keypad for operating it safely in an electronic way.

Door locks that are operated electronically, for example via smartphones are gaining an increasing market share of electrical locks. An example is found on the Internet page www.August.com, disclosing a cylindrical electrical lock casing with a lock mechanism inside having a coaxial receiver for a rotating lock pin from the lock inside the door. The cylindrical lock has an outer cylindrical lock handle as part of the casing which when rotated opens the door lock. The diameter of the cylindrical lock handle gives a lower limit of the distance necessary from the centre of the cylinder, which coincides with the position of the rotating lock pin, and to the edge of the door. As compared to slimmer door locks, this lower limit for the distance implies that a specifically sized cylindrical lock casing, the size being determined for easy rotation of the cylindrical lock handle, it is only useful for certain types of doors and not for those door types, where the position of the rotating lock pin is close to the edge of the door. In other words the lock is not versatile with respect to different door types. The latter is a problem in case that the cylindrical door lock casing should be post-mounted on doors with already existing locks with a fixed position of the rotating lock pin from the lock inside the door.

Some door locks that are driven electrically, typically also have a manual lock handle in order to select a manual opening, for example in case that the electrical driving mechanism is not properly working. Such hybrid locks are disclosed in International patent application WO2005/024160 by Bendz et al, assigned to Aptus Elektronik AB, and in Danish utility model DK201000185U3 by Henning Overgaard, assigned to Poly-Control ApS.

The typical construction in such lock is a motor that via gear wheels drives a rotating lock pin that in turn moves the lock bolt. At the rotating lock pin, the lock handle is provided in traditional way. Typically, the lock handle not only has to be twisted against the friction force of the lock bolt but also the gear wheels and the motor. This, in turn, requires additional force, which can be difficult for children or with persons with reduced force in their hands.

Thus, there is a desire for door locks actuation mechanisms that are easy to use for people with reduced force in the hand and which at the same time also are versatile for post-mounting on existing door lock mechanisms.

DESCRIPTION/SUMMARY OF THE INVENTION

It is an objective of the invention to provide an improvement in the art. It is specifically an objective to provide a door lock actuation and control system that is easy to operate even for people with reduced power in their hands. A further objective is a door lock actuation system that is flexible with respect to post-mounting on doors in which locks are already mounted and which, accordingly, have specific distance requirements between rotating lock pins and the edge of the door.

This objective is achieved with an actuation and control system for a door lock as explained in the following. It is assumed that the door lock is of the standard type and comprises a lock bolt driven by rotation of a lock pin that is functionally connected to the lock bolt. A non-limiting example of such lock is disclosed in the aforementioned WO2005/024160.

The actuation system comprises a cylindrical casing with a cylinder axis, the casing being delimited by a cylindrical handle and a rear plate and a circular front plate provided at opposite ends of the cylindrical handle. The rear plate is to be mounted towards the door. The cylindrical handle is operable with the hand and can be provided with a non-slip surface for easy manual grabbing. Typically, the cylindrical handle will have a circular outer cross sectional shape and a diameter of between 6 and 9 cm in order to be pleasant and easy to grab. Such size of handle makes it easy to manually operate a lock even with reduced power in the hands or with reduced motor skills in the fingers and hands, which often is the case for elderly people.

Alternatively, the handle can deviate from the circular shape, for example by being oval or being shaped polygonal. For example a polygonal shape may increase the grip; in this connection, it is preferred that the polygonal shape largely resembles a circle, thus, it should have many corners, such as at least 8 or at least 12 or at least 16 corners. I such polygonal case, the term "diameter of 6-9 cm" means the diameter of the circumscribed circle around the polygon.

The actuation system comprises a centred, first pin receiver provided on the cylinder axis and a second pin receiver provided off centred between the cylinder axis and the cylindrical handle, remote from the cylinder axis. Inside the casing is provided a motor which is connected to the pin receivers through a gearwheel arrangement for rotating the pin receivers when running the motor. The pin receivers have a slot for receiving one end of the lock pin, for example through the rear plate, for rotating the lock pin by the corresponding pin receiver when the motor is activated. Thereby the lock bolt is driven by the motor, once the actuation system has been mounted on a door with a lock that comprises such lock pin and lock bolt.

The actuation system with the two pin receivers is very advantageous because it solves the problem of the prior art in that it provides a cylindrical handle that is either centred around the lock pin, if there is space enough, or is mounted off-centred if the position of the lock pin is very close to the edge of the door.

Alternatively, the actuation system is not provided with two pin receivers but is provide with one pin receiver which then can be selectively provided in the most suitable position, either centred or off-centred. In a practical embodiment, the actuation system comprises a first, centred mount provided on the cylinder axis and a second mount provided off centred between the cylinder axis and the cylindrical handle and remote from the cylinder axis; the first mount and the second mount each being rotationally driven by the motor through the gear wheel arrangement and configured for receiving an adapter, thereby functioning as a base for the adapter when mounted to the first or second mount. The adapter has a slot for receiving a lock pin, why the first mount in combination with the adapter takes the role of the first pin receiver and the second mount in combination with the adapter takes the role of the second pin receiver.

The term "centred" in contrast to off-centred does not necessarily imply that the rotational axis of the first pin receiver or the first mount is exactly identical with the cylinder axis of the casing. Slight deviations due to mechanical tolerances where the first pin receiver or the first mount is approximately centred, are to be understood as being included in the term. For example, the first pin receiver or the first mount is centred in the sense that the lateral extension of the first pin receiver or the first mount overlaps with the cylinder axis of the casing, but the rotation axis of the first pin receiver or first mount does not necessarily coincide precisely with the cylinder axis. A deviation of a few millimeters, for example up to 5 millimeters, between the rotational axis of the central first pin receiver or the central first mount and the cylinder axis of the casing will still be understood as a centred location of the first pin receiver or the first mount. In contrast thereto, the second pin receiver or the second mount is off-centred in that the lateral extension of the second pin receiver or the second mount is not overlapping with the cylinder axis but its rotation axis is remote from the cylinder axis, at least 2 centimeters but typically at least 3 centimeters.

In order for the cylindrical handle to be operated by hand, it is provided manually rotational about its cylinder axis and rotational relatively to the rear plate.

An advantageous technical solution is found in the following, wherein the cylindrical handle comprises inner teeth along the inner circumference of the cylindrical handle, the inner teeth being in interlocking cooperation with the gear wheel arrangement for being driven rotationally by the motor together with the pin receiver and for driving the pin receiver when manually rotating the cylindrical handle. By connecting the cylindrical handle to the pin receiver through the gearing, the force necessary to drive the cylindrical handle can be adjusted to very easy going. The latter is highly important for use by people with reduced power in their hands, such as elderly people, disabled, and children.

For example, the first pin receiver is provided with a first gear wheel, and the second pin receiver is provided with a second gear wheel, the first and the second gear wheel being in interlocking cooperation. Thus, driving the first pin receiver also implies driving the second pin receiver. For example, the arrangement is such that the second gear wheel is in interlocking operation with the motor only through the first gear wheel. Thus, the motor is acting on the first pin receiver which in turn acts on the second pin receiver. This implies that the two pin receivers are rotating in opposite directions.

Alternatively, an intermediate gear wheel transfers the force such that the first and the second pin receivers rotate in the same direction when the motor is activated. The direction of driving is determined by the motor direction, which can be switched by proper programming and configuration.

In order to provide a smooth rotation of the cylindrical handle, minimizing production costs and weight, the following type of bearing has been found useful. In this embodiment, a plain bearing is provided between the rear plate and the cylindrical handle for rotational support of the cylindrical handle by the rear plate. For example, the cylindrical handle comprises a circular groove that is movable on a ring, where the ring is provided with the rear plate of the casing. In a practical embodiment, the plain bearing comprises a recess in the rear plate and a largely ring-shaped slider arrangement sliding inside the groove. Thus, the largely ring shaped slider arrangement is connecting the groove and the recess for sliding movement between the groove and the recess about the slider arrangement when the cylindrical handle rotates relatively to the rear plate.

An example of such slider arrangement comprises a number of plates, each curved as an arch piece of a ring, in order for the number of plates resembling a ring-formed structure when mounted in the recess and the groove.

A simple but efficient arrangement is provided by the following. In this case, the recess has a first recess part with a first width along more than ¾ of a circle, and the recess has a second recess part with a second, larger width on a remaining part of a circle. Thus, the recess has a constant width over more than ¾ of a circle but then increases on the second recess part. In that second recess part, a screw or other type of fastener is provided for fastening one of the plates in that second recess part. Further, mounting of a number of plates in the first recess part is only possible by insertion of the number of plates from the second recess part into the first recess part due to the larger width of the first recess part. Fastening of a plate in the second recess parts by the screw or other type of fastener prevents the number of plates in the first recess part from escaping from it.

The actuation system is advantageously part of a so called smartlock system. For this reason, the actuation system comprises an integrated circuit with a receiver for wireless signal, for example Bluetooth, WIFI, Z-wave, ZigBee, or radio frequency signal. The integrated circuit is configured and programmed for activating the motor in either direction upon receiving a corresponding wireless command signal by the receiver. The actuation system will typically comprise a transceiver for bidirectional digital communication with a programmable computer system for controlling the lock remotely, for example by a smartphone.

Optionally, the actuation system is provided with a touch sensitive sensor on the front plate, which when manually activated locks or unlocks the door. For example, one touch on the sensor toggles the lock between a locked and unlocked state. Alternatively, touching the touch sensitive sensor locks the door if the touch is maintained for a period of less than a predetermined time duration limit, and unlocks the door if the touch is longer, or vice versa. For example, the predetermined time duration limit is suitably 1 second, 1.5 seconds, 2 seconds or 3 seconds.

In order to control the starting and stopping of the motor, a mechanism is incorporated to measure the actual orientation of the pin receiver, and thereby the lock pin, once mounted. An example of such mechanism is as follows. In this embodiment, a gear wheel in the gear wheel arrangement is provided with a permanent magnet, and a Hall sensor is provided near to that gear wheel for measuring and indicating the positioning of the magnet in front of the Hall sensor upon rotation of that gear wheel. The Hall sensor is coupled to the integrated circuit, and the integrated circuit is programmed to halt the motion of the motor in response to the magnet reaching the Hall sensor after rotation of that gear wheel. Use of a Hall element for measuring a rotational position is disclosed in the aforementioned WO2005/024160.

In order for having flexibility when mounting the actuation system on already existing locks in doors, an adapter plate is provided for mounting on the rear plate for abutting a door. Typically, it comprises a number of threaded holes for screwing the rear plate to the adapter plate. The adapter plate is provided with a first opening corresponding to the position of the first pin receiver, and optionally a second opening for the second pin receiver. The second opening is only necessary in those countries, where the offcentred mounting is of relevance, for example in Scandinavia. For example the first and second opening are configured for a lock pin extending through the first or second opening in order for the lock pin to reach the pin receivers. The adapter plate comprises a pair of elongate mounting holes for mounting the adapter plate to a door in different positions and for different configurations of threaded fastening holes in standard door locks; the pair of mounting holes being configured for pairs of bolts extending through the adapter plate and into the standard door locks.

For example, the adapter plate comprises a plurality of identical pairs of mounting holes for mounting the adapter plate to a door in different positions, the pairs of mounting holes configured for pairs of bolts extending through the adapter plate and into standard door locks. One pair or the other may be used for mounting the lock correctly with respect to the first or the second pin receiver.

For example, one pair of mounting holes are kidney shaped and having a longitudinal bend, the bend being within an angle of between 30 and 60 degrees with to a symmetry line between the two mounting holes of the pair of mounting holes. Such holes are advantageous with respect to various systems on the market in the US, where the systems have slightly varying hole distance.

Internationally, different standards exist for lock pins such that the pin receiver has to be adapted thereto in order to function properly. For this reason, the pin receiver comprises a base mount to which an adapter is fastened. The base has a first connector, for example a slot that can also be used to directly receiving a lock pin of certain preferred type. The adapter comprises a cooperating connector at its one end for mounting the adapter on the base of the pin receiver. When mounting the adapter to the base, it forms part of the pin receiver. The adapter itself further comprises a slot for receiving an end of a lock pin. By providing a number of different exchangeable adapters with identical first connectors but each of the adapters having a different slot according to different standards of lock pins, the pin receiver can be used for various lock pins.

Thus, the actuation system gives solutions to various problems:

- It can be mounted centred or off centred—yielding high flexibility with respect to mounting on different types of door lock with different dimensioning.
- It can be adapted to various types of lock pins.
- The shape and size facilitates grabbing around the handle and manual openings of doors. Especially for elderly people with reduced motoric skills in hands and fingers.
- The reduction through the gearing of the rotating force necessary to rotate the handle is useful for people with reduced power in their hands.

SHORT DESCRIPTION OF THE DRAWINGS

The invention will be explained in more detail with reference to the drawing, where FIG. 1*a* is a perspective overview drawing of the door lock actuation system in perspective front view;

FIG. 1*b* is a perspective overview drawing of the door lock actuation system in perspective rear view, FIG. 1*c* is a perspective overview drawing of the door lock actuation system in perspective rear view with alternative adapter plate;

FIG. 1*d* is a perspective overview drawing of the door lock actuation system with a head-on rear view of the alternative adapter plate;

Figure 4A:
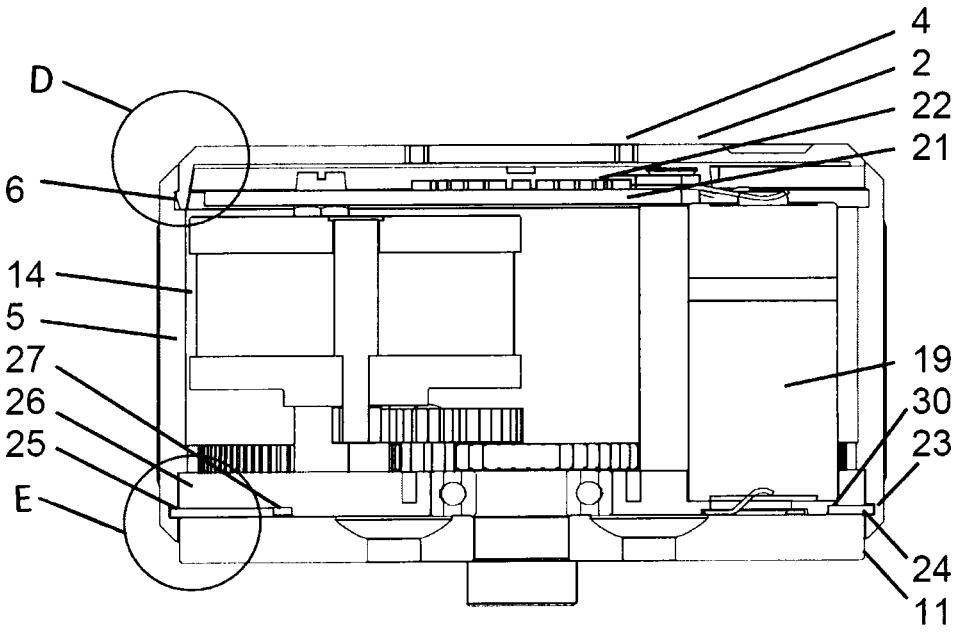
Figure 4B:
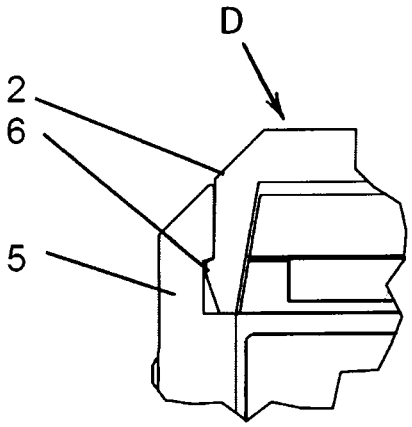
Figure 4C:
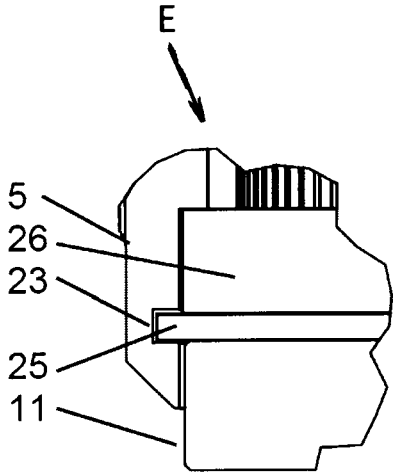
Figure 5:
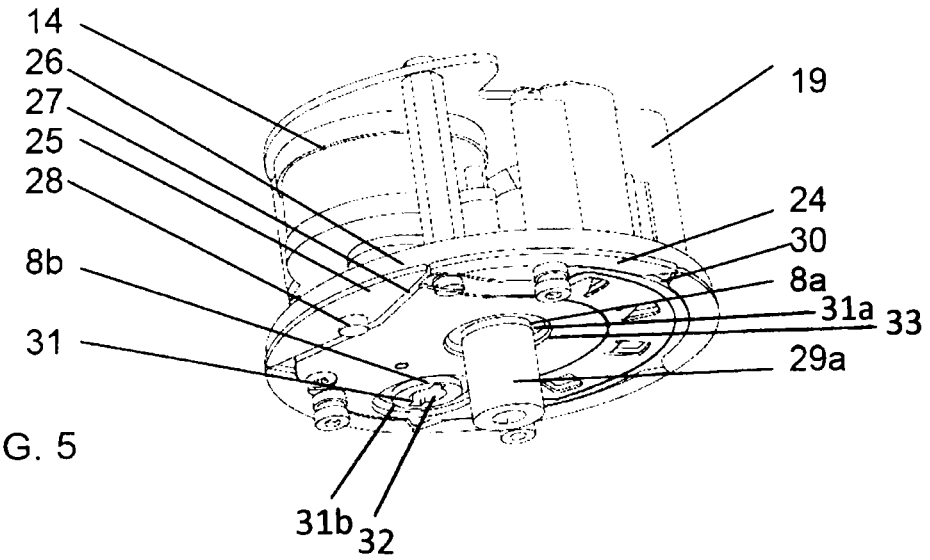
Figure 6:
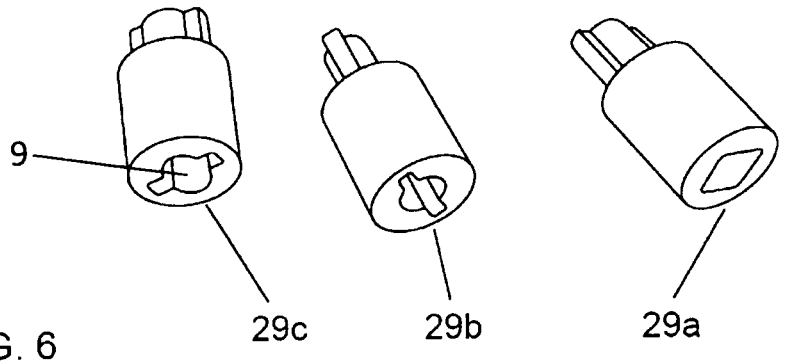

FIG. 4*a* is a view into the door lock actuator system from a cut-open side perspective;

FIG. 4*b* is an enhanced section D;

FIG. 4*c* is an enhanced section E;

FIG. 5 is a perspective drawing showing inner parts of the door lock actuator system;

FIG. 6 shows various adapters.

DETAILED DESCRIPTION/PREFERRED EMBODIMENT

Figure 1A:
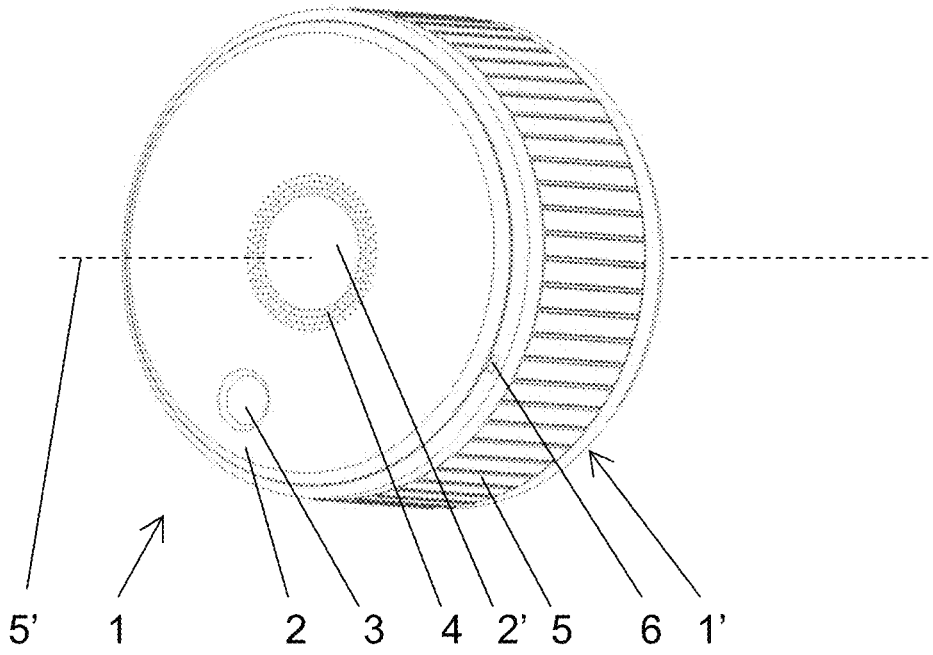
Figure 1B:
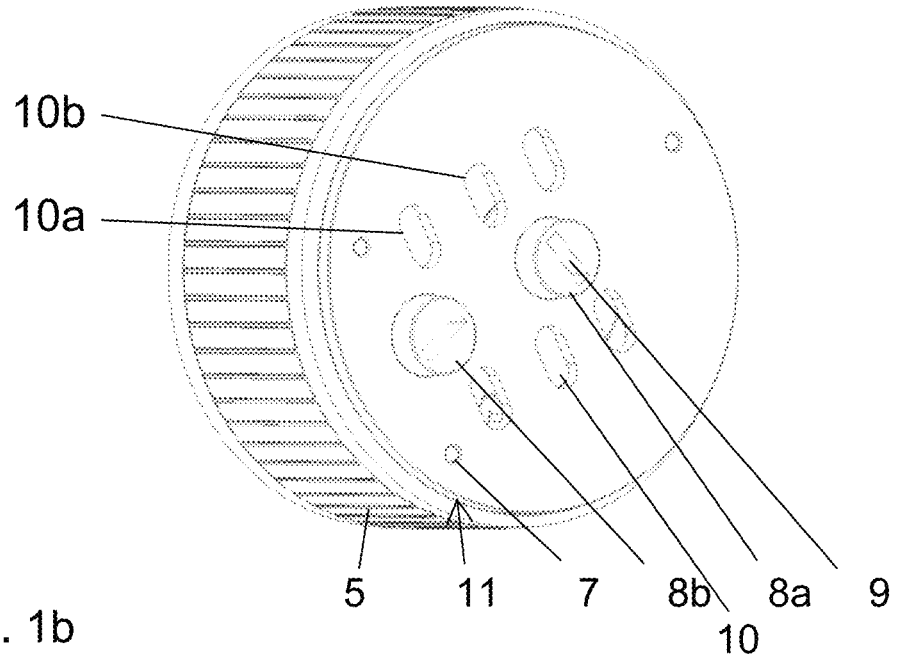

FIG. 1 illustrates a post-mount door lock actuation and control system in perspective view, where FIG. 1*a* is a front view and FIG. 1*b* is a rear view.

The actuation system 1 comprises a casing 1' with a front plate 2 with a passive visual indicator 3 that shows the rotational position of the front plate 2. The front plate 2 is provided with a circle of small windows 4 through which or from which the light from diodes is transmitted. Optionally, corresponding diodes can be provided behind the windows or inside the windows. For example, a green light transmission indicates that the door is unlocked, whereas a red light indicates that the door is locked. The front plate is fastened by a snap-lock 6 to a cylindrical handle 5. The cylindrical handle 5 forms part of the casing 1' and is mounted rotationally about a central rotation axis 5' and can be used for opening the lock manually. If the door lock is opened electrically, the cylindrical handle 5 would be driven by a motor.

Optionally, the central part 2' of the front plate 2 is equipped with a touch sensitive sensor which when manually activated locks or unlocks the door. For example, one touch on the sensor toggles the lock between a locked and unlocked state. Alternatively, touching the central part of the touch sensitive sensor 2' locks the door if the touch is maintained for a period of less than a predetermined time duration limit, and unlocks the door if the touch is longer. For example, the predetermined time duration limit is suitably 1 second, 1.5 seconds, 2 seconds or 3 seconds.

FIG. 1*b* illustrated the actuation system in perspective rear view. An adapter plate 11 constitutes the rear of the actuation system 1. The adapter plate 11 is provided with a row of pairs of elongate openings 10 as mounting holes for pairs of bolts in order to mount it onto a door in various orientations and positions. Typically, the adapter plate 11 is mounted onto the door first with screws or bolts, after which the remaining parts of the actuation system 1 are screwed onto the adapter plate 11, which for this purpose is provided with corresponding threaded screw holes 7 for screws extending from the front side and into the adapter plate 11.

Typically, the door contains a lock inside the door blade with a lock bolt that is actuated by rotating a lock pin that extends into the lock. The lock pin is rotated by a lock handle or motor mounted on the door blade or by a key inserted into the lock. The lock handle or motor comprises a pin receiver for providing a connection to the lock pin to allow the rotation thereof by hand or by the motor. Such lock handles can have various forms as already described in the introduction.

As it occurs from FIG. 1*b*, the actuation system 1 is equipped with a first pin receiver 8*a* and a second pin receiver 8*b* for receiving the rotational lock pins that drives the lock bolt inside the door. The first of the pin receivers 8*a* is provided centrally, for example with a rotational axis exactly coaxially with the cylinder axis 5' of the cylindrical handle 5 or slightly displaced with respect to the cylinder axis 5', for example a few millimeters, optionally within 5 mm from the cylinder axis. In contrast thereto, the second pin receiver 8*b* is provided off-centred relatively to the cylinder axis 5' of the cylindrical handle 5, typically a few centimeters off-centred, for example at least 2 cm or at least 3 centimeters. The advantage of having such two pin receivers 8*a*, 8*b* is a rich versatility with respect to mounting options. If the distance from the edge of the door to the location of the lock pin is less than the radius of the cylindrical handle 5, the off-centred lock pin receiver 8*b* is used. Otherwise, the central pin receiver 8*a* is used, which also has the advantage that the adapter plate 11, and thus the lock system 1, would cover even a relatively large access hole that is provided in the door blade for access to the lock inside the door.

As seen, the pin receivers 8*a* and 8*b* extend outside the adapter plate 11. Alternatively, the pin receivers are provided flush with the rear side of the adapter plate 11.

Figure 1C:
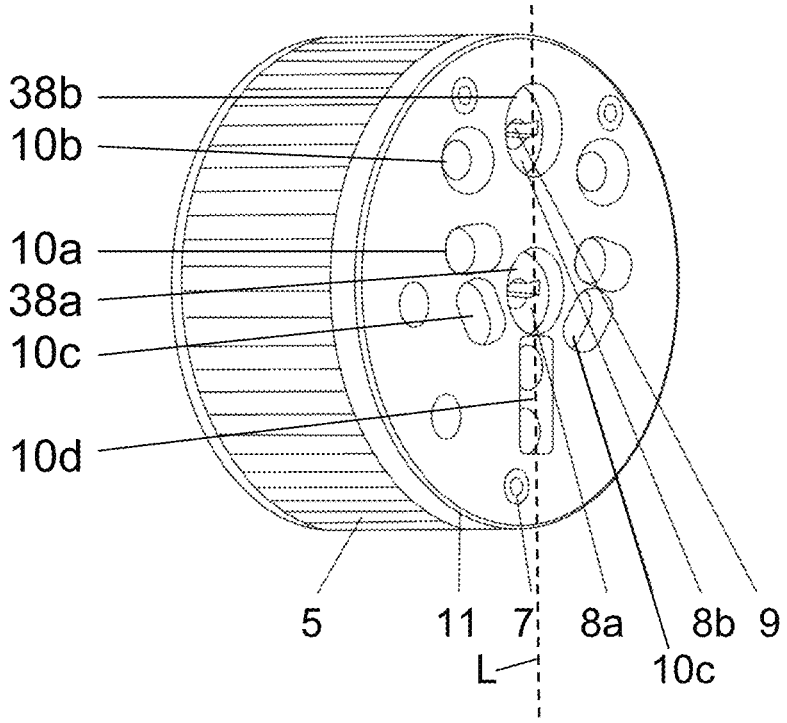

FIG. 1*c* illustrates a different embodiment for an adapter plate 11. This adapter plate 11 comprises a first pin receiver opening 38*a* that gives access to the centred pin receiver 8*a* or access to a corresponding centred mount for an adapter that in combination with the centred mount works as a centred pin receiver 8*a*. The use of adapters is explained in greater detail below in connection with FIGS. 5 and 6. Additionally, the adapter plate 11 comprises a second pin receiver opening 38*b* that gives access to the off centred pin receiver 8*b* or access to a corresponding off-centred mount for an adapter which in combination with the mount functions as off-centred pin receiver 8*b*.

Figure 1D:
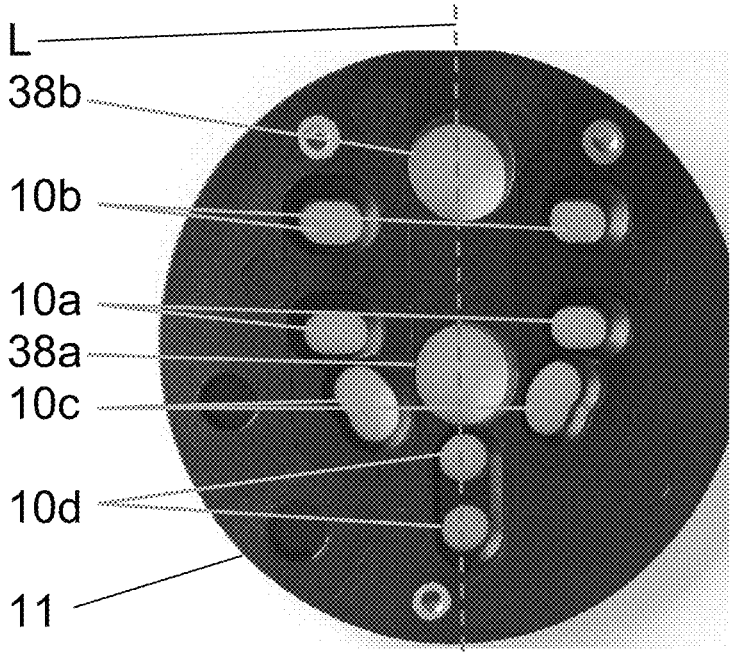

The adapter plate 11 also comprises a first pair of mounting holes 10*a* and second pair of mounting holes 10*b*. Either of the first pair of mounting holes 10*a* and the second pair of mounting holes 10*b* comprises two mounting holes that are located symmetrically about a symmetry line L, which in FIG. 1*c* and FIG. 1*d* is also connecting the centres of the first pin receiver opening 38*a* and the second pin receiver opening 38*b*. The first pair of mounting holes 10*a* has a distance to the centre of the first pin receiver opening 38*a* that is identical to the distance of the second pair of mounting holes 10*b* to the centre of the second pin receiver opening 38*b*. The first pair of mounting holes 10*a* and the second pair of mounting holes 10*b* are elongate and extending laterally from the line L, which is best illustrate in FIGS. 1*b* and 1*d*. These first and second pairs of openings 10*a*, 10*b* correspond to the lock standard dimensions typically used in Europe, for example Scandinavia. Specifically, the second pair of mounting holes 10*b* is used for off centred mounting in Scandinavia in cases where the off-centred pin receiver 8*b* is used, and the first pair of mounting holes 10*a* is used for the centred mounting, for example in accordance with typical European standards.

As illustrated in FIG. 1*c*, there is a third pair of mounting holes 10*c*, that comprises two elongate openings arranged symmetrically on either side of the symmetry line L. This third pair of mounting holes 10*c* have an elongate direction that extends under an angle of between 30 and 60 degrees with the line L.

As best illustrated in FIG. 1*d*, which shows the adapter plate 11 with a side facing up which is normally facing towards the inside of the casing 1', the third pair of mounting holes 10*c* are kidney-shaped, also called bean-shaped, why the elongate direction of the holes is bending. This kidney shape is made for adaption to various lock systems on the market in the US, including the locks under the trademarks of Kwikset, Baldwin, Schlage, and Yale. A fourth pair of mounting holes 10*d* is located on the line L and is to be used as screw holes for locks of the European standard of locks.

The off-centred pin-receiver 8*b* is typically used in Scandinavian doors, why the adapter plate 11, for example when used outside Scandinavia, can be modified to not contain an off-centered opening 38*b* and not comprise the second pair of mounting holes 10*b*. In this case, only the centred pin-receiver 8*a* would be possible to use, and the various mounting possibilities are included by the first pair of mounting holes 10*a* and the third pair of mounting holes 10*c* and optionally also the fourth pair of mounting holes 10*d*.

Figure 2:
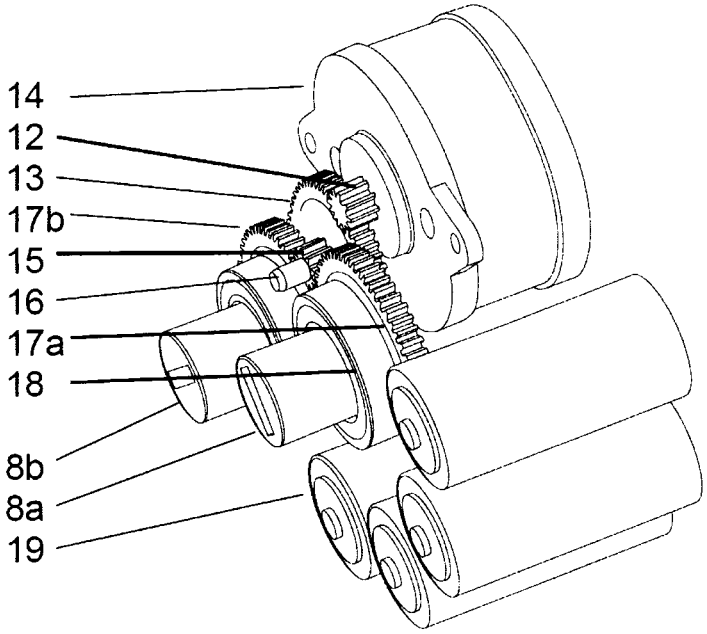
FIG. 2 is a perspective drawing of the gearing system.

FIG. 2 illustrates the motorised driving mechanism for the pin receivers 8*a*, and 8*b*. The motor 14 receives current from a number of batteries 19. The motor 14 drives a motor gear wheel 12 that in turn drives a larger gear wheel 13 in order to reduce the rotation speed. The larger gear wheel 13 is fastened to an axle 16 on which a further small gear wheel 15 is fastened as well. This further small gear wheel 15 drives the first gear wheel 17*a* of the first pin receiver 8*a* and the second gear wheel 17*b* of the pin receiver 8*b*, for example by being in direct cooperation only with the first gear wheel 17*a* of the off/centred pin receiver 8*a*, whereas the first gear wheel 17*a* transmits the driving force to the second gear wheel 17*b*.

In case that only one pin receiver 8*a* or 8*b* is to be mounted, the gear wheel system is configured for the further small gear wheel 15 to be connected to the gear wheel 17*a* or 17*b* of that particular mounted pin receiver 8*a* or 8*b*. If the actuation system is configured for comprising both pin receivers 8*a*, 8*b*, simultaneously, the further small gear wheel 15 will drive the first of the gear wheels 17*a* or 17*b* of the pin receiver which in turn drives the second of the gear wheels 17*b* or 17*a*. Depending on whether the central pin receiver 8*b* or the off-centre pin receiver 8*a* is used, the motor 14 direction may have to be adjusted for locking and unlocking the door, respectively. This is typically done through software applications. Alternatively, an intermediate gear wheel is provided that transfers the rotation from one pin receiver to the other pin receiver, by which the rotation of the pin receivers are in the same direction simultaneously.

Figure 3:
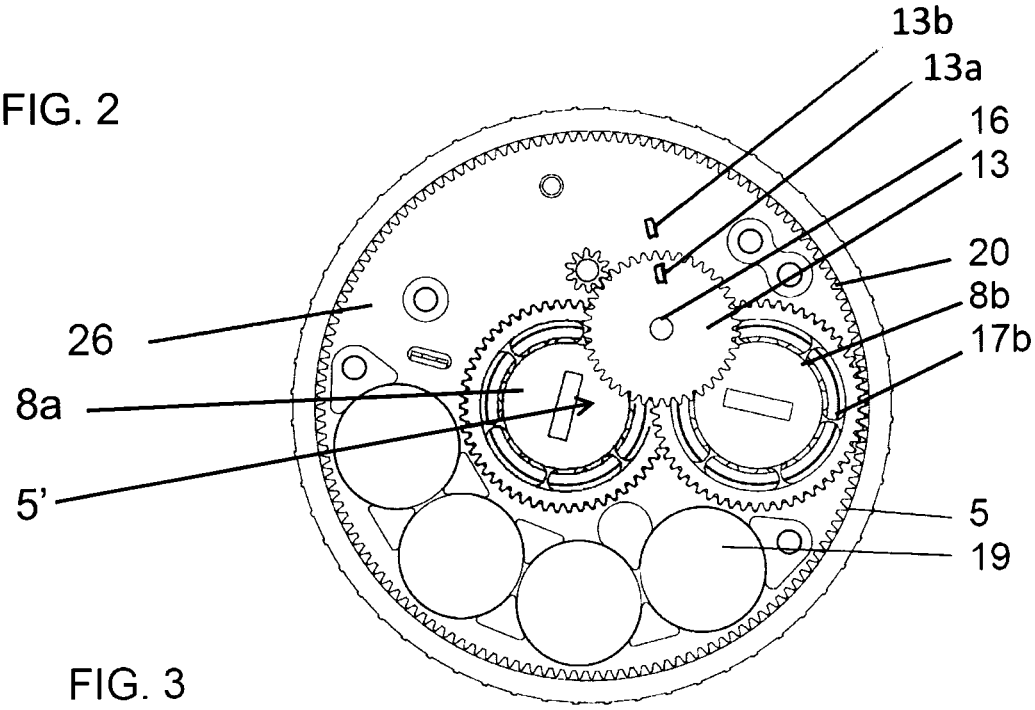
FIG. 3 is a drawing with a view inside the casing from the back.

FIG. 3 illustrates the actuation system as seen from the rear direction inside the casing where the adapter plate has been removed as well as a rear plate to be explained later. Two pin receivers 8*a*, 8*b* are shown, but only the second gear wheel 17*b* of the second pin receiver 8*b* for simplicity. Visible is the larger gear wheel 13 which is fastened to the axle 16 on which also the further small gear wheel 15 is mounted, which however is hidden by the larger gear wheel 13 in this drawing. When the motor 14 drives the first gear wheel 17*a*, the cylindrical handle 5 is rotating as well due to the gear train connection between the outer teeth 20 of the second gear wheel 17*b* and inner teeth of the cylindrical handle 5. In turn, if the cylindrical handle 5 is manually rotated, the second gear wheel 17*b* is driven for actuating the lock pin (not shown) and the lock bolt (not shown), which is mechanically connected to the opposite end of the lock pin.

It is seen that the central pin receiver 8*a* has a rotational axis slightly offset from the position of the cylinder axis 5' of the casing 1', as indicated by the arrow 5'; however, the lateral cross section, which is the cross section normal to the rotational axis, of the central pin receiver 8*a* extends across the cylinder axis 5', why it is justified to term it central pin receiver 8*a* despite slightly displaced rotation axis relatively to the cylinder axis 5'. It is noted that the slight displacement of the centred pin receiver, which is typically less than 5 mm, is much less than the distance from the cylinder axis to the rotations axis of the off-centred pin receiver, which is typically more than 20 mm, for example more than 30 mm.

FIG. 4*a* is a view into the actuation system from a cut-open side-perspective. It also shows the cylindrical axis as a stippled vertical line. As illustrated in FIG. 4*a*, there are two circular sections D and E, which, respectively, are shown in enhanced view in FIG. 4*b* and FIG. 4*c*. Behind the windows 4 in the front plate 2, diodes 22 are provided for indicating the locking status of the door. For example, a green light transmission indicates that the door is unlocked, whereas a red light indicates that the door is locked. The diodes 22 are provided on a printed circuit board (PCB) 21 with an integrated circuit for communication between the motor, the diodes, and an external wireless communication system, such as a WIFI, Bluetooth, Zigbee, or Z-wave system or another type of wireless radio frequency system. Further, there may be provided a magnet 13*a* in a gear wheel and a Hall sensor 13*b* for indicating to the integrated circuit when the magnet is rotated to the front of the Hall sensor, which can be used by the integrated circuit or by a wireless connected computer system to determine whether a door is in a locked or open state.

The front plate 2 is fastened to the cylindrical handle 5 by a snap connection 6, which is illustrated in greater detail in FIG. 4*b*. The cylindrical handle 5 is connected to a rear plate 26 by a plain bearing. The plain bearing comprises a groove 23 in the cylindrical handle 5 in cooperation with a ring of slider plates 24, 25 which are used to secure and hold the cylindrical handle 5 in rotational connection to the rear plate 26.

The typical mounting procedure is as follows. The adapter plate 11 is mounted onto the door blade. Subsequently, one of the pin receivers 8*a* or 8*b* is pushed over the lock pin from the door lock. While the specific pin receiver 8*a* or 8*b* is accommodating the lock pin, the rear plate 26 is screwed onto the adapter plate 25 in threaded screw holes 7. For the latter to be possible, the front plate 2 is removed and re-mounted after the fastening of the rear plate 26 onto the adapter plate 25.

FIG. 5 illustrates a largely ring shaped slider arrangement with the number of plates 24, 25, each curved as an arch piece of a ring, in order for the number of plates resembling a ring-formed structure when mounted in the recess and the groove. The slider plates 24 and 25 are accommodated in a recess that resembles a circle and that has a first recess part 30, which is a peripheral recess, and a second recess part 27 which has a larger width than the first recess part 30. A first slider plate 25 is fastened to the rear plate 26 by a screw 28. The first slider plate 25 is accommodated in a correspondingly shaped second recess part 27. Removing the screw 28 allows removal of the first slider plate 25 from the second recess part 27. Once, the first slider plate 25 is removed from the second recess part 27, the further slider plates 24 can be inserted into the first recess part 30 or removed from the first recess part 30 by pushing them along the first recess part 30 and into the first, wider, second recess part 27. They can only be inserted or removed through the second recess part 27, which has a width larger than the width of the first recess part 30. Shown are one first slider plate 25 and four further slider plates 24, however, the number could be different, for example 3 or 5 further slider plates 24. Once mounted in the first recess part 30 and accommodated in the groove 23 of the cylindrical handle 5, as illustrated in FIG. 4*a*, the further slider plates 24 cannot be removed from the first recess part 30 in other ways that through the second recess part 27. Thus, when the first slider plate 25, which is also accommodated in the groove 23, is installed and fastened by a screw 28, the combination of the first slider plate 25 and the further slider plates 24 in the groove 23 provide a plain bearing which centres the cylindrical handle 5 about the rear plate 26.

As illustrated in FIG. 5, the central pin receiver 8*a* is provided as a combination of a central mount 31*a* and an adapter 29*a* in order to adapt the opening 32 of the pin receiver 8*a* or 8*b* with the actual lock pin cross section. The adapter 29*a*, 29*b*, 29*c* can have different configuration, as illustrated in FIG. 6, and is mounted onto a central mount 31*a* or off-centered mount 31*b*, which form a base for the adapter. A selection of such different adapters 29*a*, 29*b*, 29*c* is shown in FIG. 6. The adapters 29*a*, 29*b*, 29*c* have identical mail parts on one end for fitting into the mount opening 33 of the central mount 31*a* or the off-centered mount 31*b* and have different female parts at the opposite end in order to adjust the system to various international standards for lock pins.

The various adapters 29*a*, 29*b*, 29*c* and the feature of the central pin receiver 8*a* and off-centred pin receiver 8*b* makes the system very flexible with respect to mounting on different types of doors and with different door lock standards.

The actuation system may be configured with a centred mount 31*a* and an off-centred mount 31*b* for receiving in the respective mount an adapter 29*a*, 29*b*, 29*c*, where the mount 31*a*, 31*b* in combination with the adapter 29*a*, 29*b*, 29*c* constitutes the corresponding centred or off-centred pin receiver 8*a*, 8*b*. Such adapter 29*a*, 29*b*, 29*c* can be moved to the corresponding mount 31*a*, 31*b* in the centred position or the off centred position. Alternatively, the actuation system is provided with one adapter on each of the two mounts 31*a*, 31*b* but such that one of these adapters can be removed in order for the adapter plate 11 to flush with the door blade.

The invention claimed is:

1. Actuation system for a door lock, where the door lock comprises a lock bolt driven by rotation of a lock pin that is functionally connected to the lock bolt; the actuation system comprising a cylindrical casing (1') with a cylinder axis (5'), the casing (1') being delimited by a cylindrical handle (5) with an outer diameter of between 6 and 9 cm, and a rear plate (26) and a circular front plate (2) provided at opposite ends of the cylindrical handle (5); wherein the actuator system comprises a centred, first pin receiver (8*a*) provided on the cylinder axis and an off-centred, second pin receiver (8*b*) provided between the cylinder axis and the handle remote from the cylinder axis; wherein inside the casing being provided a motor (14) which is connected to the first and the second pin receiver (8*a*, 8*b*) through a gear wheel arrangement (12, 13, 15, 17*a*, 17*b*) for rotating the pin receivers (8*a*, 8*b*) when running the motor (14); the pin receivers (8*a*, 8*b*) having a slot (9) for receiving one end of the lock pin for rotating the lock pin when the motor (14) is activated.

2. Actuation system according to claim 1, wherein the cylindrical handle (5) is provided rotational about its cylinder axis and rotational relatively to the rear plate (26); wherein the cylindrical handle (5) comprises inner teeth (20) along the inner circumference of the cylindrical handle (5), the inner teeth (20) being in interlocking cooperation with the gear wheel arrangement (17*b*) for being driven rotationally by the motor (14) together with the pin receiver (8*a*, 8*b*) and for driving the pin receiver (8*a*, 8*b*) when manually rotating the cylindrical handle (5).

3. Actuation system according to claim 1, wherein the first pin receiver (8*a*) is provided with a first gear wheel (17*a*), and the second pin receiver (8*b*) is provided with a second gear wheel (17*b*), the first and the second gear wheel (17*a*, 17*b*) being in interlocking cooperation, and wherein the second gear wheel (17*b*) is in interlocking operation with the motor only through the first gear wheel (17*a*).

4. Actuation system according to claim 1, wherein a plain bearing is provided between the rear plate (26) and the cylindrical handle (5) for rotational support of the cylindrical handle (5) by the rear plate (26), wherein the plain bearing comprises a groove (23) in the cylindrical handle (5) and a recess (27, 30) in the rear plate (26) and a largely ring shaped slider arrangement connecting the groove (23) and the recess (27, 30) for sliding movement between the groove (23) and the recess (27, 30) about the slider arrangement when the cylindrical handle (5) rotates relatively to the rear plate (26).

5. Actuation system according to claim 4, wherein the slider arrangement comprises a number of plates (24, 25), each curved as an arch piece of a ring, in order for the number of plates resembling a ring-formed structure when mounted in the recess (23) and the groove (27, 30).

6. Actuation system according to claim 5, wherein the recess (27, 30) has a first recess part (30) with a first width along more than ¾ of a circle, and the recess has a second recess part (27) with a second, larger width on a remaining part of a circle; wherein on the second recess part (27), a screw (28) or other type of fastener is provided for fastening one of the plates (25) in that second recess part (27); wherein mounting of a number of plates (24) in the first recess part (30) is only possible by insertion of the plates (24) from the second recess part (27) into the first recess part (30) due to the larger width of the first recess part (27); and wherein fastening of a plate (25) in the second recess part (27) by the screw (28) or other type of fastener prevents the number of plates (24) in the first recess part (30) from escaping from it.

7. Actuation system according to claim 1, wherein the actuation system comprises an integrated circuit with a receiver for wireless signal; the integrated circuit being configured and programmed for activating the motor (14) in either direction upon receiving a corresponding wireless command signal by the receiver.

8. Actuation system according to claim 7, wherein a gear wheel in the gear wheel arrangement is provided with a permanent magnet, and wherein a Hall sensor is provided near to that gear wheel for measuring and indicating the positioning of the magnet in front of the Hall sensor upon rotation of that gear wheel; wherein the Hall sensor is coupled to the integrated circuit, and the integrated circuit is programmed to halt the motion of the motor in response to the magnet reaching the Hall sensor after rotation of that gear wheel.

9. Actuation system according to claim 1, wherein an adapter plate (11) is provided on the rear plate (26) for abutting a door, the adapter plate (11) being provided with a first and second opening (38*a*, 38*b*) corresponding to the position of the first and second pin receiver (8*a*,8*b*); the adapter plate (11) also comprising a number of threaded holes (7) for screwing the rear plate to the adapter plate (11); the adapter plate further comprising pairs of elongate mounting holes (10, 10*a*, 10*b*, 10*c*) for mounting the adapter plate (11) to a door in different positions and for different configurations of threaded fastening holes in standard door locks; the pairs of mounting holes (10, 10*a*, 10*b*, 10*c*) configured for pairs of bolts extending through the adapter plate (11) and into the standard door locks.

10. Actuation system according to claim 1, wherein an adapter plate (11) is provided on the rear plate (26) for abutting a door, the adapter plate (11) being provided with a first opening (38*a*) corresponding to the position of the first pin receiver (8*a*); the adapter plate (11) comprising a number of threaded holes (7) for screwing the rear plate to the adapter plate (11); the adapter plate (11) further comprising a pair of elongate mounting holes (10*c*) for mounting the adapter plate (11) to a door in different positions and for different configurations of threaded fastening holes in standard door locks; the pair of mounting holes (10*c*) being configured for pairs of bolts extending through the adapter plate (11) and into the standard door locks; each of the mounting holes in the pair of mounting holes (10*c*) being kidney shaped.

11. Actuation system according to claim 10, wherein the kidney shaped mounting holes in the pair of mounting holes (10*c*) have a longitudinal bend, the bend being within an angle of between 30 and 60 degrees with to a symmetry line (L) between the two mounting holes of the pair of mounting holes (10*c*).

12. Actuation system according to claim 1, wherein the pin receiver (8*a*, 8*b*) comprises a base (31*a*, 31*b*) and an adapter (29*a*, 29*b*, 29*c*), the base (31) being configured as a mound for the adapter (29*a*, 29*b*, 29*c*) and having a first connector (9), and the adapter (29*a*, 29*b*, 29*c*) having a cooperating connector for mounting the adapter (29*a*, 29*b*, 29*c*) on the base (31*a*, 31*b*) of the pin receiver (8*a*, 8*b*), thereby forming part of the pin receiver (8*a*, 8*b*); the adapter (29*a*, 29*b*, 29*c*) further comprising a slot (32) for receiving an end of a lock pin; wherein a number of different exchangeable adapters (29*a*, 29*b*, 29*c*) are provided with identical first connectors but each of the adapters having a different slot (32), the different slots (32) being configured to different lock pin standards.

13. An adapter plate (11) for an actuation system (1) according to claim 1, wherein the adapter plate is provided with a centred opening (38*a*) corresponding to the position of a pin receiver (8*a*) in the actuation system; the adapter plate (11) comprising a number of threaded holes (7) for fastening the adapter plate (11) the actuation system; the adapter plate (11) further comprising a pair of elongate mounting holes (10*c*) for mounting the adapter plate (11) to a door in different positions and for different configurations of threaded fastening holes in standard door locks; the pair of mounting holes (10*c*) being configured for pairs of bolts extending through the adapter plate (11) and into the standard door locks; each of the mounting holes in the pair of mounting holes (10*c*) being kidney shaped.

14. An adapter plate according to claim 13, wherein the kidney shaped mounting holes in the pair of mounting holes (10*c*) have a longitudinal bend, the bend being within an angle of between 30 and 60 degrees with to a symmetry line (L) between the two mounting holes of the pair of mounting holes (10*c*).

15. Actuation system according to claim 1, wherein the pin receiver is provided as a combination of a mount (31*a*, 31*b*) and an adapter (29*a*, 29*b*, 29*c*), the mount having an opening into which an end part of the adapter is demountably inserted, the adapter having an opposite end part comprising the slot (9) for receiving one end of the lock pin.

* * * * *